US005529023A

United States Patent [19]

Boardman

[11] Patent Number: 5,529,023

[45] Date of Patent: Jun. 25, 1996

[54] GRAPNEL BOAT ANCHOR

[76] Inventor: Thomas K. Boardman, Rte. 2, Box 134, Pollywog Point, LaBelle, Fla. 33935

[21] Appl. No.: 497,788

[22] Filed: Jul. 3, 1995

[51] Int. Cl.[6] ..... B63B 21/24

[52] U.S. Cl. ..... 114/303

[58] Field of Search ..... 114/294, 298, 114/301, 302, 303

Related U.S. Application Data

[63] Continuation of PCT/DE93/00344, Apr. 21, 1993.

[56] References Cited

U.S. PATENT DOCUMENTS

| | | |
|---|---|---|
| 203,087 | 4/1878 | Swinburne . |
| 721,663 | 3/1903 | Brooke . |
| 2,643,630 | 6/1953 | Buck . |
| 4,403,564 | 9/1983 | Garvin . |
| 4,823,721 | 4/1989 | Pekny . |
| 5,092,261 | 3/1992 | Bertrand ..... 114/303 |

OTHER PUBLICATIONS

Piloting, Seamanship And Small Boat Handling, by Elbert S. Maloney, 1975, p. 95, FIG. 612 (a) and (b).

*Primary Examiner*—Stephen Avila
*Attorney, Agent, or Firm*—Merrill N. Johnson

[57] ABSTRACT

A grapnel anchor having an elongated shank with a fixed arm at its lower end and several movable arms mounted on the elongated shank. Each movable arm is mounted on the shank by a polygonal hole in the center of the arm. The upper end of the shank is enlarged to prevent removal of the movable arms from the anchor's shank. The upper portion of the shank beneath its enlarged upper end is a cylinder sized to permit each of the movable arms to rotate about the upper cylindrical portion of the shank. The outer surface of the lower portion of the shank between its cylindrical portion and the anchor's fixed arm consists of several identical elongated rectangles which in cross section forms a regular polygon slightly larger than the polygonal hole in the center of the movable arms.

6 Claims, 1 Drawing Sheet

GRAPNEL BOAT ANCHOR

FIELD OF INVENTION

My invention lies in the field of boat anchors, particularly anchors used on sport fishing and pleasure boats.

BACKGROUND OF THE INVENTION

Grapnel anchors have long been used by commercial fishermen but are not popular with sport fishermen or pleasure boaters. The typical grapnel has a multiplicity of fixed arms. Due to the limited space on sports fishing and pleasure boats and the desire to store their anchors flat and near the bow, Danforth and other types of anchors which can be stored flat against the forward deck of most sports fishing and medium sized pleasure boats are the choice of most boat builders and owners.

On both grassy and hard coral sea bottoms however Danforth and similar plow-type anchors do not hold as well as multi-fluked grapnel anchors. Additionally I have found that the typical grapnel often does not provide sufficient holding power.

BRIEF DESCRIPTION OF THE INVENTION

I have invented an improved grapnel anchor which not only provides excellent holding power on most sea bottoms but is capable of storage in the limited space available on sports fishing boats and most pleasure boats. My improved grapnel can be stored flat against the forward deck of most boats and occupies less or the same space required by other types of anchors. In addition, its holding power is often greater than that of other grapnel anchors.

Briefly put, my anchor includes an elongated shank with a typical curved arm affixed to the lower end of the shank and a fluke on each end of the fixed arm. Two or more movable arms shaped similarly to the fixed arm are mounted on the shank by means of a hole in the center of each movable arm and the upper end of the shank is enlarged to prohibit removal of the movable arms from the shank.

The shank has a unique construction which underlies my invention. The upper portion of the shank beneath its enlarged upper end is cylindrical, that is, circular in cross section, and the surface of the lower portion of the shank consists of a plurality of similar flat elongated rectangles. Thus in cross section the lower portion of the shaft may be an equilateral triangle, a hexagon or an octagon.

In the case where in cross section the lower portion of the shank in cross section is triangular, the hole in each of the two movable arms is triangular and sized to just fit over and slide along the lower portion of the shank. To store the anchor, the two movable arms are aligned parallel to each other and to the fixed arm and nested against the fixed arm. To deploy the anchor, the two movable arms slide up the upper cylindrical portion of the shank and rotate 60° to each other and then slide down over the lower triangular portion of the shank to provide six flukes equally spaced about the shank which normally allows a minimum of three flukes to be in contact with the sea bottom.

BRIEF DESCRIPTION OF THE DRAWINGS

The appended drawings illustrate several embodiments of my improved grapnel anchor and supplement the description set forth in the text of this specification.

DESCRIPTION OF THE PREFERRED EMBODIMENTS

Figure 1:
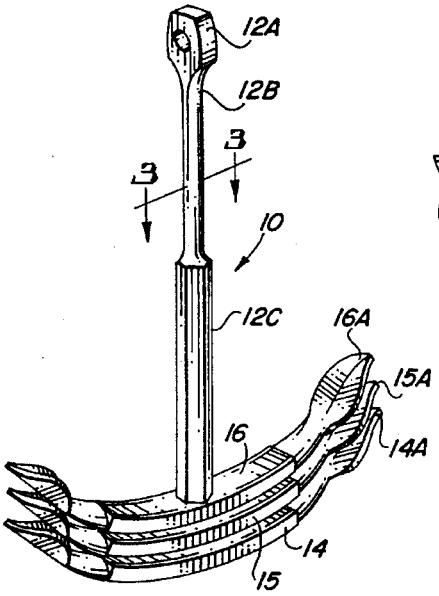
FIG. 1 is a perspective view of a first preferred embodiment of my grapnel anchor having six flukes with the anchor's two movable arms in their stored position.
Figure 4:
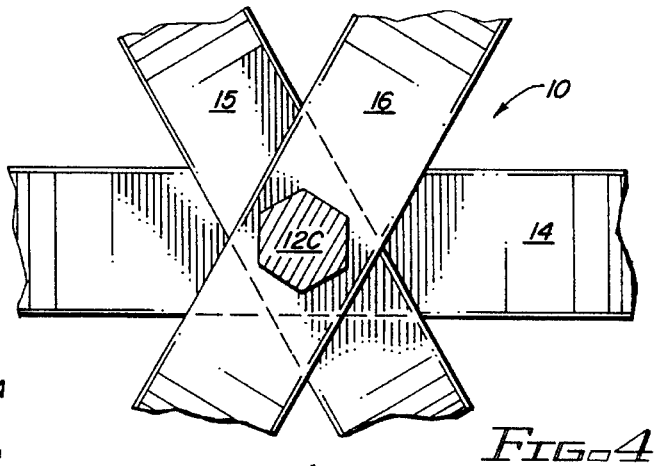
FIG. 4 is an elevational view partially broken away and taken from above of the anchor shown in FIGS. 1 and 2 with its two movable arms in their deployed position.
Figure 2:
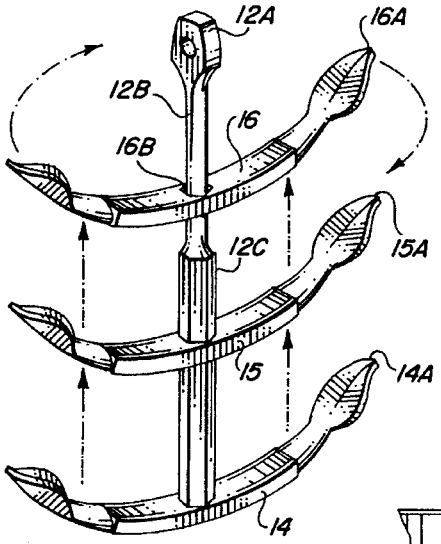
FIG. 2 is a perspective view of the first preferred embodiment of my grapnel anchor with the anchor's two movable arms being moved up the anchor's shank and into a position where the movable arms can be rotated into their deployed positions.
Figure 3:
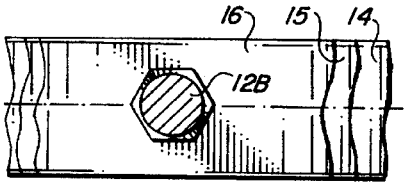
FIG. 3 is an elevational view partially broken away taken along line 3—3 of FIG. 1.

FIGS. 1, 2, 3 and 4 illustrate a preferred embodiment of my improved grapnel anchor 10 in both its stored and deployed positions. FIGS. 1 and 3 show anchor 10 in its stored position. FIG. 4 shows anchor 10 in its deployed position.

Anchor 10 includes a shank 12, fixed arm 14 and two movable arms 15 and 16. Elongated shank 12 includes a cylindrical upper portion 12B just below upper end 12A and a lower portion 12C whose surface consists of six identical elongated rectangles which in cross section form a hexagon.

A typical curved arm 14 with diamond-shaped flukes 14A at each end is affixed to the lower end of shank 12 to form the crown of anchor 10.

Two movable arms 15 and 16 with diamond-shaped flukes 15A and 16A respectively are mounted onto shank 12 by identical hexagonal holes such as hole 16B shown in FIG. 2. Hole 16B is sized to permit rotation of arm 16 about the cylindrical portion 12B of the shank as shown in FIG. 2 and to permit arm 16 to slip over the hexagonal lower portion 12C of the shank.

When it is desired to deploy anchor 10, that is, to anchor the boat, anchor 10 is removed from its stored position preferably on the bow deck of the boat. As shown in FIG. 2, arms 15 and 16 are moved up to the cylindrical portion 12B of the shank where arms 15 and 16 are rotated into positions as shown in FIG. 4 in which the flukes of arms 14, 15 and 16 lie 60° apart, thus assuring that at least three diamond-shaped flukes touch the sea bottom.

Figure 5:
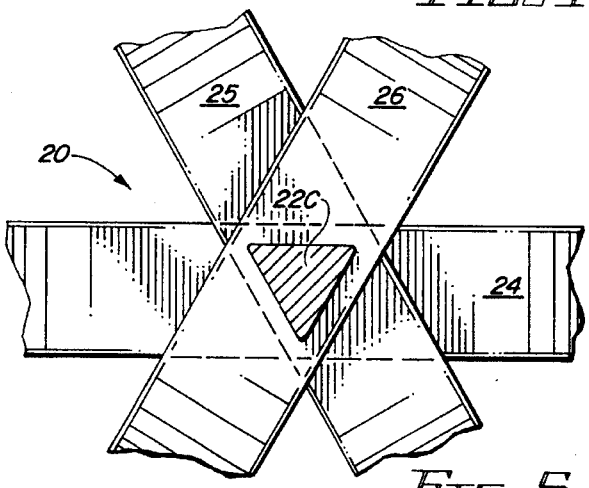
FIG. 5 is an elevational view partially broken away of a second preferred embodiment in which the lower portion of the anchor's shank is triangular in cross section and the holes in the two moveable arms are also triangular with the two movable arms shown in their deployed position.

FIG. 5 illustrates a second preferred embodiment of my improved grapnel anchor 20. Anchor 20 is constructed and operates exactly like anchor 10 except for two differences. The shank of anchor 20 includes a lower portion 22C whose surface consists of three identical elongated rectangles which in cross section form an equilateral triangle and its two movable arms 25 and 26 each include a triangular hole sized to fit over the triangular portion 22C of the shank, all as shown in FIG. 5.

Figure 6:
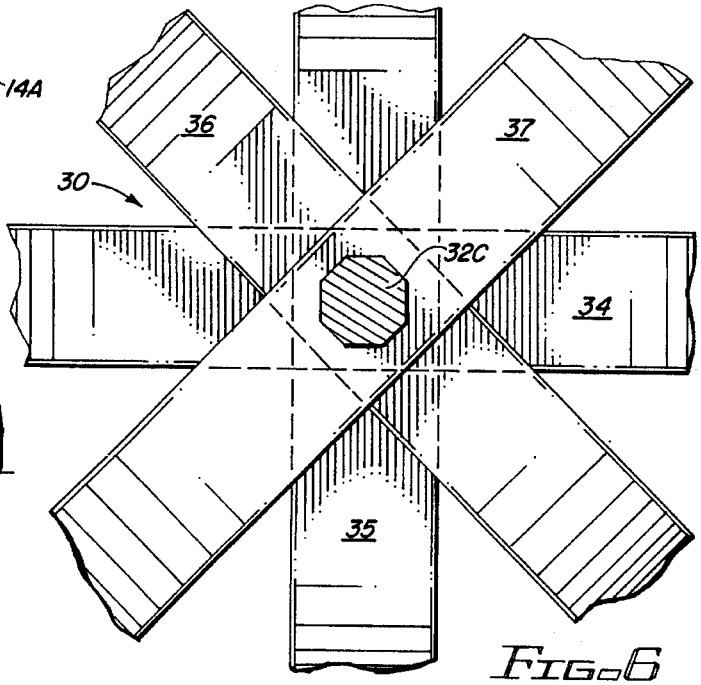
FIG. 6 is an elevational view partially broken away and taken from above of a third preferred embodiment of my improved grapnel anchor in which the lower portion of the anchor shank is octagonal and which has three movable arms with octagonal holes.

FIG. 6 illustrates a third preferred embodiment of my improved grapnel anchor 30. Anchor 30 is constructed and operates similarly to anchor 10 except for three differences. Anchor 30 includes three movable arms 35, 36 and 37, and the shank of anchor 30 includes a lower portion 32C whose surface consists of eight identical elongated rectangles which in cross section form an octagon, and the three movable arms 35, 36 and 37 each include either a square or an octagonal hole sized to fit over the octagonal portion 32C on the shank, all as shown in FIG. 6.

While I have shown and described three embodiments of my grapnel anchor, no limitation whatsoever should be inferred from this disclosure. The scope of my invention is defined only by the appended claims.

I claim:

1. A grapnel anchor having an elongated shank and a curved arm whose midpoint is affixed to the lower end of the shank, the fixed arm having a fluke permanently mounted at each end of the arm, comprising an elongated shank having a cylindrical portion near the upper end of the shank and a portion near the lower end of the shank whose surface in cross section is an equilateral triangle, and two arms generally similar in shape to the fixed arm attached to the lower end of the shank with a fluke at each end of each arm, each arm being movably mounted on the anchor's shank by a triangular hole in the center of the arm, the size and shape of the triangular hole in each arm permitting rotation of the arm about the shank when the arm is positioned along the cylindrical portion of the shank but prohibiting rotation when the arm is positioned along the lower end of the shank, thereby allowing the two movable arms to be parallel with and next to the fixed arm when the anchor is stored or at an angle to the fixed arm when deployed, and the upper end of the shank is enlarged to prevent the removal of the two movable arms from the shank.

2. A grapnel anchor is set forth in claim 1 in which all of the anchor's flukes are similar diamond-shaped flukes.

3. A grapnel anchor having an elongated shank and a curved arm whose midpoint is affixed to the lower end of the shank, the fixed arm having a fluke permanently mounted at each end of the arm, comprising an elongated shank having a cylindrical portion near the upper end of the shank and a portion near the lower end of the shank whose surface in cross section is an equilateral hexagon, and two arms generally similar in shape to the fixed arm attached to the lower end of the shank with a fluke at each end of each arm, each arm being movably mounted on the anchor's shank by a hexagonal hole in the center of the arm, the size and shape of the hexagonal hole in each arm permitting rotation of the arm about the shaft when the arm is positioned along the cylindrical portion of the shank but prohibiting rotation when the arm is positioned along the lower end of the shank, thereby allowing the two movable arms to be parallel with and next to the fixed arm when the anchor is to be stored or at an angle to the fixed arm when deployed, and the upper end of the shank is enlarged to prevent the removal of the two movable arms from the shank.

4. A grapnel anchor as set forth in claim 3 in which all of the anchor's flukes are similar diamond-shaped flukes.

5. A grapnel anchor having an elongated shank and a curved arm whose midpoint is affixed to the lower end of the shank, the fixed arm having a fluke permanently mounted at each end of the arm, comprising an elongated shank having a cylindrical portion near the upper end of the shank and a portion near the lower end of the shank whose surface in cross section is an equilateral octagon, and three arms generally similar in shape to the fixed arm attached to the lower end of the shank with a fluke at each end of each arm, each arm being movably mounted on the anchor's shank by an octagonal hole in the center of the arm, the size and shape of the octagonal hole in each arm permitting rotation of the arm about the shank when the arm is positioned along the cylindrical portion of the shank but prohibiting rotation when the arm is positioned along the lower end of the shank, thereby allowing the three movable arms to be parallel with and next to the fixed arm when the anchor is stored or at an angle to the fixed arm when deployed, and the upper end of the shank is enlarged to prevent the removal of the three movable arms from the shank.

6. A grapnel anchor as set forth in claim 5 in which all of the anchor's flukes are similar diamond-shaped flukes.

* * * * *